US009409682B2

(12) United States Patent
Newsom et al.

(10) Patent No.: US 9,409,682 B2
(45) Date of Patent: Aug. 9, 2016

(54) NON-REMOVABLE CONTAINER NECK RING

(71) Applicant: Owens-Brockway Glass Container Inc., Perrysburg, OH (US)

(72) Inventors: Daniel L. Newsom, Noblesville, IN (US); Roger P Smith, Perrsyburg, OH (US); Jessica R Bryant, Toledo, OH (US); Oleg Feygenson, Saint-Petersburg (RU); Igor Kachko, Saint-Petersburg (RU); Vladimir Vasikyev, Saint-Petersburg (RU)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 456 days.

(21) Appl. No.: 13/832,659

(22) Filed: Mar. 15, 2013

(65) Prior Publication Data

US 2014/0263156 A1 Sep. 18, 2014

(51) Int. Cl.
*B65D 45/34* (2006.01)
*B65D 41/34* (2006.01)

(52) U.S. Cl.
CPC ..... *B65D 41/3495* (2013.01); *B65D 2101/003* (2013.01)

(58) Field of Classification Search
CPC .... B65D 1/023; B65D 41/3495; B65D 49/00; B65D 55/026; B65D 55/066; B65D 2101/0084; B65D 2203/00; B65B 43/00; B23P 11/00; C09D 11/00; G09F 3/04; A61L 2/28
USPC ..... 215/14, 17–21, 49–50, 230, 258, 366; 220/86.4, DIG. 34; 222/563, 569–570; 206/495.1, 807; 283/72, 95
See application file for complete search history.

(56) References Cited

U.S. PATENT DOCUMENTS

| | | | | | |
|---|---|---|---|---|---|
| 712,183 | A | * | 10/1902 | Alfi | 215/26 |
| 1,042,669 | A | | 10/1912 | Gruver | |
| 1,308,697 | A | | 7/1919 | Cadmus | |
| 1,415,741 | A | * | 5/1922 | Walsh | B65D 49/04 215/14 |
| 1,994,625 | A | | 3/1935 | Tivoli | |
| 2,025,498 | A | * | 12/1935 | Desmond | B65D 49/04 215/21 |
| 2,091,460 | A | | 8/1937 | Valliant et al. | |
| 2,125,788 | A | * | 8/1938 | Johnson | B65D 55/08 215/252 |
| 2,141,174 | A | * | 12/1938 | Davis | 215/21 |
| 2,153,427 | A | * | 4/1939 | Fleisch | B65D 55/022 215/252 |
| 2,228,542 | A | * | 1/1941 | Volkmann | B65D 55/06 215/251 |
| 2,626,723 | A | * | 1/1953 | Onorato | 215/20 |
| 3,073,470 | A | * | 1/1963 | Greene | 215/22 |

(Continued)

FOREIGN PATENT DOCUMENTS

| | | | |
|---|---|---|---|
| BE | 378261 | A | 4/1931 |
| GB | 03632 | A | 3/1911 |

OTHER PUBLICATIONS

PCT Search Report and Written Opinion, Int Serial No. PCT/US2014/020712, Int Filing Date: Mar. 5, 2014, Applicant: Owens-Brockway Glass Container Inc., Mail Date: Jun. 5, 2014.

*Primary Examiner* — J. Gregory Pickett
*Assistant Examiner* — Brijesh V. Patel

(57) ABSTRACT

A product includes a container including a neck, and a ring non-removably secured to the neck of the container. The ring may be used to non-removably couple a fitment to the container and/or may be adapted irreversibly to change a characteristic of the ring that is visible from outside of the container to advise a user that the package has been opened.

22 Claims, 7 Drawing Sheets

(56) References Cited

U.S. PATENT DOCUMENTS

| | | | | | |
|---|---|---|---|---|---|
| 3,399,811 | A | * | 9/1968 | Miller | 222/147 |
| 3,603,472 | A | | 9/1971 | Lecinski, Jr. et al. | |
| 3,899,295 | A | | 8/1975 | Halpern | |
| 4,067,472 | A | | 1/1978 | Cruickshank | |
| 4,182,461 | A | | 1/1980 | Waldau | |
| 4,217,988 | A | * | 8/1980 | Mills et al. | 215/21 |
| 4,299,328 | A | * | 11/1981 | Ochs | B65D 41/3447 215/252 |
| 4,411,369 | A | | 10/1983 | Borows | |
| 4,449,637 | A | | 5/1984 | Snedker | |
| 4,489,841 | A | | 12/1984 | Thompson | |
| 4,502,605 | A | | 3/1985 | Wloszczyna | |
| 4,505,399 | A | | 3/1985 | Weiner | |
| 4,511,052 | A | | 4/1985 | Klein et al. | |
| 4,573,582 | A | * | 3/1986 | Kusz | B65D 55/08 215/232 |
| 4,775,061 | A | * | 10/1988 | Coote | B65D 50/068 215/215 |
| 5,096,813 | A | * | 3/1992 | Krumhar | B65D 55/026 422/401 |
| 5,443,987 | A | | 8/1995 | DeCicco et al. | |
| 5,617,812 | A | | 4/1997 | Balderson et al. | |
| 5,806,697 | A | | 9/1998 | Harbutt et al. | |
| 5,971,179 | A | | 10/1999 | Christmas et al. | |
| 6,378,906 | B1 | | 4/2002 | Pennaz | |

* cited by examiner

NON-REMOVABLE CONTAINER NECK RING

The present disclosure is directed to containers and, more particularly, to container attachments.

BACKGROUND AND SUMMARY OF THE DISCLOSURE

Many containers are provided with tamper-resistant devices to resist refilling of contents in the containers. For example, a beverage container can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a container including an attachment ring for a container that may be used as an anchor to non-removably secure a fitment to the container, as a use-evident indicator carried by the container to indicate that the container has been opened and/or that original liquid product has been dispensed from the container, and/or as a tamper-indicator to evidence efforts to tamper with the package via breakage of the container.

The present disclosure embodies a number of aspects that can be implemented separately from or in combination with each other.

A product in accordance with one aspect of the disclosure includes a container including a neck having an interior passage, and a ring non-removably coupled to the container neck.

In accordance with another aspect of the disclosure, there is provided a method of producing a product that includes (a) flowing liquid into a container having a neck, and (b) non-removably coupling a fitment into the neck of the container via an attachment ring to render the product tamper-evident.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
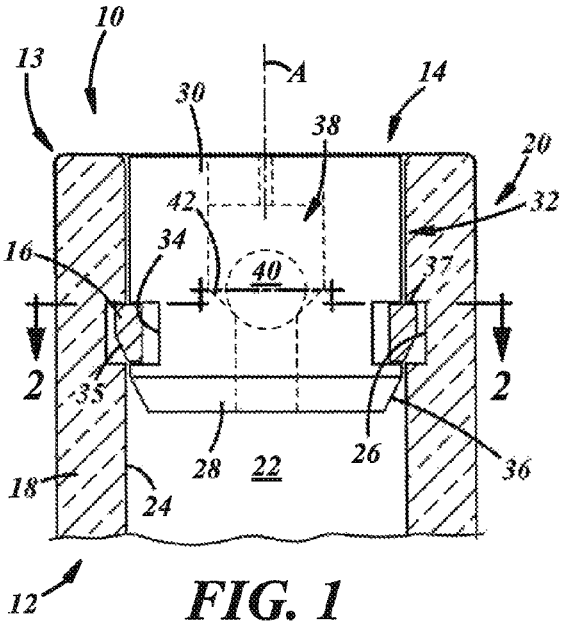
FIG. 1 is a fragmentary, elevational, sectional view of a package in accordance with an illustrative embodiment of the present disclosure and including a container, a closure coupled to the container, a fitment coupled to the container to render the container non-refillable, and an attachment ring for the container which may be used as an anchor for coupling the fitment to the container, as a use-evident feature, and/or as a tamper-evident feature.

FIG. 1 illustrates a package 10 in accordance with an illustrative embodiment of the disclosure as including a container 12 to hold an original product therein, a closure 13 to close the container 12, a dispensing fitment 14 coupled to the container 12 for non-refillable dispensing of the product out of the container 12, and a ring 16 attached to the container 12 for one or more purposes. For example, and as will be described in further detail below, the ring 16 may be used as a fitment anchor or coupler to attach the fitment 14 to the container 12, as a use-evident indicator for indicating that the container 12 has been opened and/or that the product has been dispensed from the container 12, and/or as a tamper-indicator for evidencing efforts to tamper with the package 10.

Although not illustrated, the package 10 also may include any suitable seals between the fitment 14 and the container 12, and/or at least a portion of the fitment 14 may be interference fit within the container 12 for integral sealing therebetween.

The container 12 may be, for example, a jug, a jar, or a bottle, for instance, a wine or spirits bottle, or any other suitable type of food or beverage container, and may be composed of glass or ceramic, or any other suitable material(s). The original product may include beer, wine, liquor, soda, other beverage, or any other suitable liquid, or food. Although not illustrated in the drawings, the container 12 may include a bottom or base, a body that may extend in a direction axially away from the base along a central longitudinal axis A, a shoulder extending in a direction axially away from the body, and a neck 18 extending in a direction axially away from the shoulder and including a neck finish 20. As used herein, directional words such as top, bottom, upper, lower, radial, circumferential, lateral, longitudinal, transverse, vertical, horizontal, and the like are employed by way of description and not limitation. Although not shown, the neck finish 20 may include one or more closure engagement elements, for example, helical threads, capping flange, and/or any other suitable feature(s), for coupling of the closure 13 to the container 12.

The container neck 18 may include an interior passage 22 to carry the fitment 14 and to communicate liquid out of the container body and through and out of the neck 18. The passage 22 may include a radially inner surface 24, and an internal annular recess 26 in the inner surface 24 for receiving at least a portion of the ring 16. The interior passage 22 may be of cylindrical shape or of any other suitable geometry. The recess 26 may be a circumferentially continuous groove that may be rectangular in transverse cross section, per the illustrated embodiment of FIG. 1, or may be of any other suitable shape and configuration.

The closure 13 may include a cover, for example, a metal foil, plastic cup, wax seal, or any other suitable cover. Although not illustrated in the drawings, in other embodiments, the closure 13 also or instead may include a threaded closure, crown closure, or the like, or a cork, plug, or any other suitable closure. In the latter embodiments, artisans of ordinary skill will recognize that the fitment 14 would be located further down into the container neck 18 to accommodate such an internal closure.

The fitment 14 may include a first end 28, a second end 30 disposed axially oppositely of the first end 28, and an axially extending circumferential outer wall 32 that may be disposed between the ends 28, 30 and in contact with the interior surface 24 in the passage 22 of the container 12. The outer wall 32 may be of cylindrical shape, or of any other suitable shape corresponding to the shape of the interior surface 24 of the container neck 18. The fitment 14 also may include an external annular recess 34 in the outer wall 32 corresponding to the internal annular recess 26 of the container 12 and for receiving at least a portion of the ring 16. Accordingly, the fitment recess 34 may be axially aligned with and overlapping the container recess 26. The fitment recess 34 may be a circumferentially continuous groove that may be rectangular in transverse cross section, per the illustrated embodiment of FIG. 1, or may be of any other suitable shape and configuration. As used herein, the term transverse may mean disposed at some non-zero angle with respect to the longitudinal axis A of the container 12 and along any direction intersecting the container 12 and may include but is not limited to a radial direction. The fitment 14 also may include a chamfer 36 between the first end 28 and the outer wall 32. Various features of the fitment 14 illustrated in the drawing figures are illustrative only, and may be of any other suitable type or construction.

The fitment 14 further may include any suitable features to impede or prevent refilling of the container 12. For example, the fitment 14 may include a check valve 38 that may be carried within the outer wall 32. The check valve 38 may include a check ball 40 and a valve seat 42, and/or any other suitable elements to permit flow of product out of the container 12 but prevent or retard flow of product into the container 12. Non-refillable fitments are well known to those of ordinary skill in the art, and any suitable type of non-refillable fitment may be used, whether a check valve type of fitment, an air trap type of fitment, or any other suitable type of refill-resistant fitment.

The fitment 14 may be non-removably secured to the container 12. The terminology "non-removably secured" includes a manner in which the fitment 14 is, by design-intent, not intended to be removed from the container 12 without damaging the container 12 and/or the fitment 14, or otherwise visibly compromising the structural and/or functional integrity of either or both. Also, the fitment 14 may render the container 12 non-refillable. In other words, the fitment 14 may prevent or at least impede efforts to refill the container 12, for example, with counterfeit products. The terminology "non-refillable" is used interchangeably herein with the terms refill-resistant and anti-refill, and includes a characteristic of the fitment 14 which, by design intent, is not intended to be refilled without damaging the container 12 and/or fitment 14 or otherwise visibly compromising the structural and/or functional integrity of either or both.

The ring 16 is at least partially radially disposed in the container recess 26 and in the fitment recess 34 so as to radially overlap both the container 12 and the fitment 14 to secure the fitment 14 to the container 12. More specifically, the ring 16 may be axially trapped by corresponding axially facing shoulders of the container 12 and the fitment 14 located adjacent the corresponding recesses 26, 34. The ring 16 may be rectangular in transverse cross section, as illustrated in FIG. 1, or may of any other suitable shape. The ring 16 may be composed of glass, metal, or any other suitable material. For instance, the ring 16 may be composed of a ferrous metal, for instance, iron or steel, to facilitate separation (via magnets or the like) of the ring 16 from container material during recycling. In other embodiments, the ring 16 may be composed of aluminum, copper, titanium, stainless steel, or non-metal.

Figure 2:
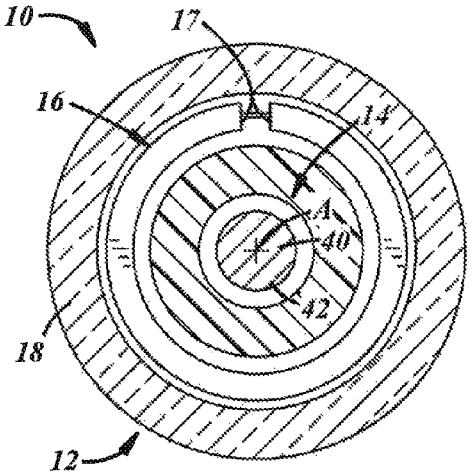
FIG. 2 is a sectional view of the package of FIG. 1, taken along line 2-2 of FIG. 1.

In the embodiment illustrated in FIGS. 1 and 2, the ring 16 may be a split ring, in other words, extending less than 360 angular degrees such that the ring 16 includes circumferential ends 17 (FIG. 2). Accordingly, the ring 16 may be resilient or spring-like, such that a radial force may be imposed on the ring 16 to radially inwardly deflect the ring 16 from a rest state toward a radially compressed state, but wherein the ring 16 returns toward its rest state upon removal of the force. Accordingly, the ring 16 may be radially resiliently compressible, for example, to facilitate assembly of the ring 16 to the container 12 and to facilitate assembly of the fitment 14 to the container 12.

The resilient ring 16 is illustrated in a rest state, but when the fitment 14 is assembled to the container 12, the resilient ring 16 is compressible in a radially inward direction to a compressed state to allow the fitment 14 to be inserted into the container neck 18. For example, the ring 16 may be C-shaped or semi-circumferential, having circumferential ends, circumferentially spaced apart from one another. The ring 16 may include an annular chamfer 35 to facilitate insertion of the fitment 14 into the container neck 18 under a force greater than that supplied by the weight of the fitment 14 alone. The ring 16 is resiliently expandable from the compressed state back to the rest state when the ring 16 axially traverses or clears an internal feature of the container 12. For example, the ring 16 may axially clear the internal surface 24 of the neck 18 and expand resiliently back to its rest state into the groove 26 where a trailing surface or edge 37 of the ring 16 is engageable with an axially facing shoulder of the container 12, for example, at an axial side of the groove 26. At that point, the fitment 14 becomes non-removably secured within the container 12.

In production of the container 12, the recess 26 may be produced by forming or machining. In one embodiment, the recess 26 may be formed during blank molding or blow molding of the container 12. For example, the recess 26 may be formed by a blank mold or finish mold plunger having an expandable annular portion. During blank forming or finish forming, the plunger would extend into a blank or container neck, the expandable annular portion of the plunger would expand radially outwardly to form the recess 26, and then the expandable annular portion would retract radially inwardly to allow retraction of the plunger. Then, the container 12 may be annealed and, thereafter, the ring 16 may be assembled into the formed recess 26.

In another embodiment, the ring 16 may be coupled to the container 12 during molding of the container 12 or after the container 12 is molded. For example, the ring 16 may be insert-molded within a blank mold or a blow mold of a container manufacturing process.

In a further embodiment, after forming of the container 12, the container neck 18 may be machined to produce the recess 26, for example, via grinding, milling, turning, or the like. More specifically, a milling cutter or trepan tool may be inserted into the container neck 18 and spun at high velocity to remove material of the container neck 18 to define the recess 26. Accordingly, the recess 26 would be well-defined and would accommodate assembly of the ring 16 thereto after machining. In this embodiment, the machined recess 26 may require stress relieving via heat treatment before assembly of the ring 16 to avoid weakness in the region of the recess 26.

Referring again to FIG. 1, during packaging, the original product may be flowed into the container 12 in any suitable manner, and then the fitment 14 may be coupled into the neck 18 of the container 12 via the ring 16 to render the product 10 tamper-evident. For example, the ring 16 may be compressed radially until its radially outer diameter is smaller than the radially inner diameter of the passage 22 of the container neck 18, and then the ring 16 may be inserted into the passage 22 of the container neck 18 and into axial alignment with the container recess 26. Thereafter, the ring 16 may be released to allow the ring 16 to expand into the container recess 26. Next, the fitment 14 may be inserted into the passage 22 of the container neck 18 wherein the fitment chamfer 36 engages a radially inner surface or edge of the ring 16 and continued insertion of the fitment 14 causes radially outward displacement or expansion of the ring 16. Finally, when the fitment 14 has been inserted such that the external recess 34 axially aligns with the internal annular recess 26 of the container 12, the ring 16 snaps back or expands back toward its rest state and radially overlaps the recesses 26, 34 to axially restrain the fitment 14 relative to the container 12. The engagement between the ring 16 and the container 12 and the fitment 14 is such that the fitment 14 cannot be removed without causing visible damage to the container 12 and/or to the fitment 14.

Although the groove 26 is illustrated as an example of the container internal feature, any other suitable internal feature (s) could be used. For example, the ring 16 could be retained axially between axially spaced internal embossments or shoulders of the container neck 18, by separate components installed in the neck 18, or by any other suitable feature(s) to retain the ring 16. More specifically, the ring 16 may be coupled between radially inwardly extending portions of the container neck 18.

Figure 1A:
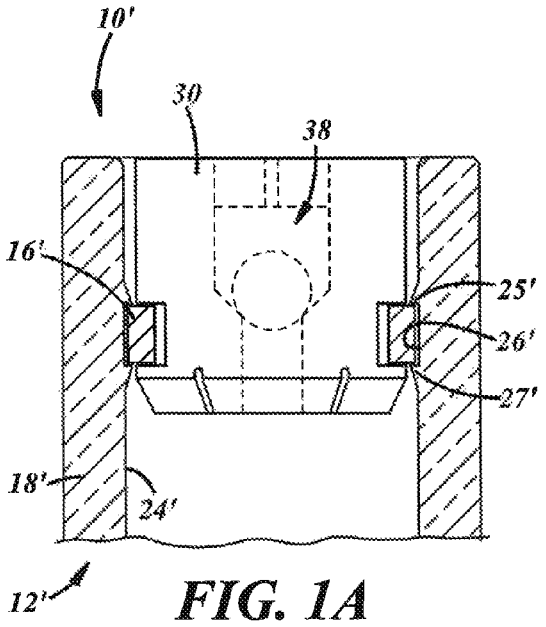
FIG. 1A is a fragmentary, elevational, sectional view of a package in accordance with another illustrative embodiment of the present disclosure, similar to that of FIG. 1.

As illustrated in FIG. 1A, for example, a package 10' may include a container 12', which may be formed to include a first annular detent 25' extending radially inwardly from an inner surface 24' of a container neck 18'. The container 12' also may be formed to include a second annular detent 27' spaced axially from the first annular detent 25' and which may establish a groove 26' therebetween. In any case, the fitment 30 carrying the ring 16' may be inserted into a neck 18' of the container 12', wherein the ring 16' may be compressed radially inwardly, until the ring 16' snaps past the first annular detent 25' and into the groove 26'. At that point, the ring 16' may relax or be uncompressed wherein the ring 16' is axially trapped between the detents 25', 27'.

Figure 3:
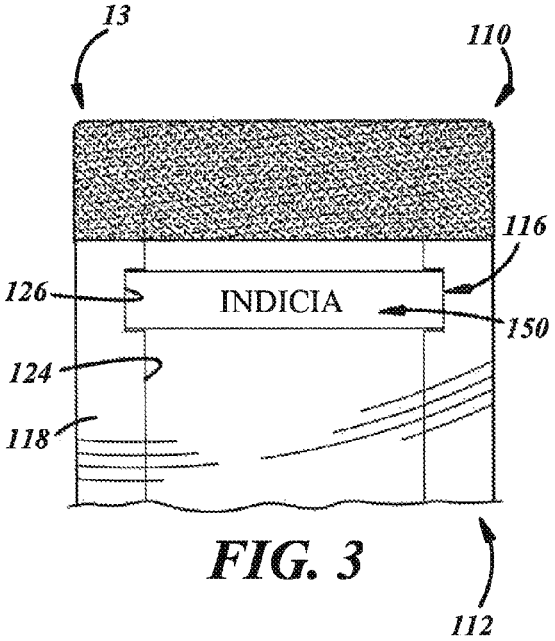
FIG. 3 is a fragmentary elevational view of a package in accordance with another illustrative embodiment of the present disclosure, and including a container, a closure coupled to the container, and an attachment ring for the container which may be used as an anchor for coupling a fitment to the container, as a use-evident feature, and/or as a tamper-evident feature.

FIG. 3 illustrates another illustrative embodiment of a package 110 including a container 112 and a ring 116 non-removably coupled to the container 112. This embodiment is similar in many respects to the embodiment of FIGS. 1-2 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The indicator ring 116 may be the same as or similar to an indicator disclosed and shown in U.S. patent application Ser. No. 13/832,589 filed Mar. 15, 2013 (entitled CONTAINER HAVING A USE INDICATOR), which was filed on the same date as the present application and is assigned to the assignee hereof and is incorporated herein by reference in its entirety.

The container 112 includes a neck 118 and an internal annular recess 126 for receiving the ring 116. In this embodiment the ring 116 may be in diametric contact with the container 112 within the recess 126. The ring 116 may facilitate evidencing of efforts to tamper with the package 110, for example, via breakage of the container 112 when someone attempts to remove or defeat a non-refillable fitment and refill the container 112. In this regard, and although not shown, the package 110 also may include a fitment that may be inserted into the container neck 118 and non-removably secured thereto, for example, by being snap fit to the ring 116 in any suitable manner. For example, the fitment may be inserted into the container neck 118 wherein a fitment chamfer engages a radially inner surface or edge of the ring 116 and continued insertion of the fitment causes radially inward displacement or contraction of a resiliently radially compressible portion of the fitment. As used herein, the terminology "snap fit" includes abrupt engagement of two members (with or without audible or tactile feedback) via spring-like or resilient deflection of at least a portion of one of the members and, once installed, the deflected portion may return to or toward its original shape. When the fitment has been inserted such that an external annular recess axially aligns with an internal annular recess of the container 112, the compressible portion of the fitment snaps back or expands back toward its rest state such that one or more axially facing shoulders of the fitment engage against the ring 116 to axially restrain the fitment relative to the container 112 so that the fitment cannot be removed without causing visible damage to the container 112.

The ring 116 may function as a heat concentrator, wherein the ring 116 may be composed of a material that expands at a faster rate and to a greater degree than the material of the container 112. For example, the ring 116 may be composed of metal, for instance, steel, when the container 112 is composed of glass or ceramic. Then, if counterfeiters attempt to melt a plastic portion of the fitment by applying heat to the fitment, the ring 116 will expand radially and axially and, thus, break the container neck 118, thereby facilitating evidence of tampering with the container 112 and likely rendering the container 112 unusable. In this embodiment, the container 112 would break because the ring 116 expands radially and/or axially to a greater extent than a corresponding portion of the container 112 for a given temperature and, thus, the expanding ring 116 would stress the container 112 beyond its breaking point.

Furthermore, an outer surface of the ring 116 may carry indicia 150, for example, brand name indicia, package serial number indicia, a logo, a slogan, or the like. The indicia 150 may be recessed in a radially outer surface of the ring 116 wherein the indicia 150 may be formed, machined, lasered, etched, or produced in any other suitable manner. Accordingly, the indicia 150 are positioned on the inside of the container 112 but are visible therethrough.

Moreover, the ring 116 may evidence opening or dispensing of original product from the container 112 for example, via a state change of the ring 116 after the package 110 has been opened and/or original product has been dispensed from the container 112. The ring 116 may be of any suitable composition(s) and constructed in any suitable manner to enable the ring 116 to exhibit different visual characteristics. For example, the ring 116 may be composed of a base material, and an oxidizable coating carried by the base material. The base material may include a metal, and the coating may include a reactive material that reacts with any one or more of the constituents of air so as to visibly change appearance of the material. For example, the air-reactive material may include an oxygen-reactive material or a nitrogen-reactive material. More specifically, the air-reactive material may include oxygen-reactive metals, polymers, or dyes. For instance, the air-reactive material may include copper, iron, potassium, sodium, PEN (polyethylene naphthalate), polycarbonate, or one or more flavonoids, for example, flavanones, flavanoles and dihydrochalcones, chalcones, aurones, or anthocyanidins, depending on the reaction and desired color.

During product packaging, the ring 116 may be assembled to the container 112 in an inert environment in any suitable manner, and the closure 13 may be sealingly applied to the container 112 to prevent oxidation of the ring 116. Accordingly, in the sealed package 110, the ring 116 may exhibit a first visual characteristic, for example, a first color.

Figure 4:
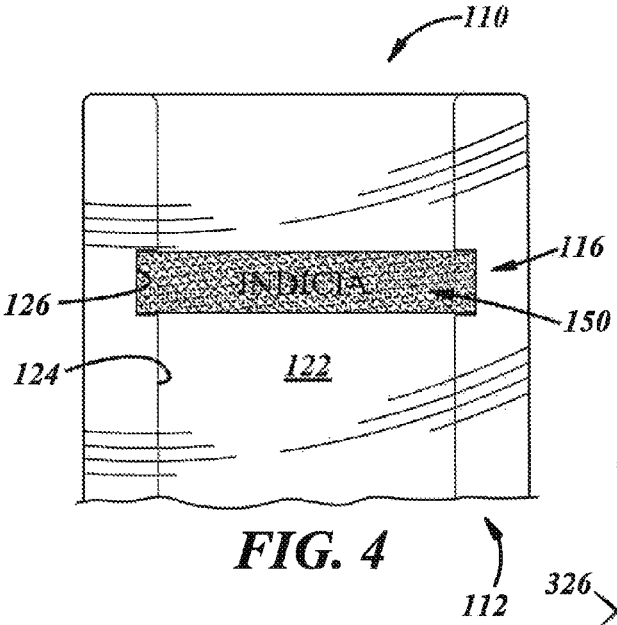
FIG. 4 is a fragmentary elevational view of the package of FIG. 3, with the closure removed, and illustrating the attachment ring in its use-evident state.

But, referring now to FIG. 4, upon contact with air, for example, when the package 110 is opened, the ring 116 is adapted irreversibly to change a characteristic of the ring 116 that is visible from outside of the container 112 to advise a user that the package 110 has been opened. Accordingly, the ring 116 will exhibit the second visual characteristic different from the first visual characteristic. For example, the ring 116 is illustrated in FIG. 4 in a state different from that shown in FIG. 3. In particular, the ring 116 may be a different color after the package 110 has been opened.

Therefore, the ring 116 may provide a security feature. The package 110 may be opened and, thereafter, if counterfeiters attempt to refill the emptied container 112 with counterfeit liquid product and repackage the package 110 with a closure, the refilled and repackaged package will include the state changed ring 116 as evidence of product refilling and repackaging. In other words, the package 110 is permanently or irreversibly identifiable as being a once-fillable package. Over time, purchasers will become educated to spot refilled counterfeit packages. Thus, counterfeiters will be deterred from offering counterfeit packages to such educated purchasers.

Figure 5:
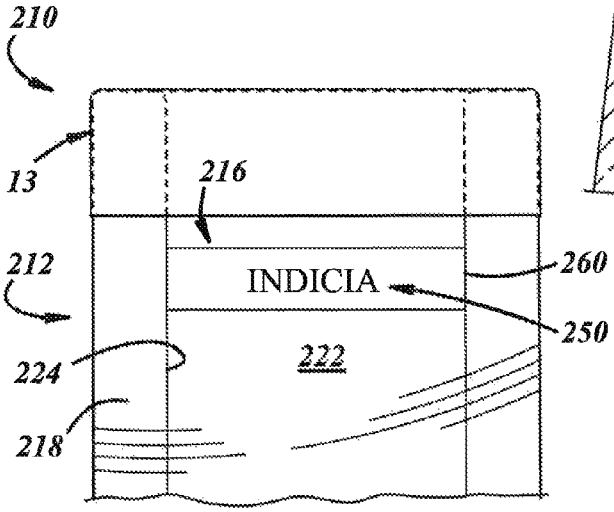
FIG. 5 is a fragmentary elevational view of a package in accordance with a further illustrative embodiment of the present disclosure and including a container, and an attachment ring for the container which may be used as an anchor for coupling a fitment to the container, as a use-evident feature, and/or as a tamper-evident feature.

FIG. 5 illustrates another illustrative embodiment of a package 210 including a container 212 and a ring 216 non-removably coupled to the container 212. This embodiment is similar in many respects to the embodiment of FIGS. 1-4 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The container 212 includes a neck 218 and an interior surface 224 for receiving the ring 216. In this embodiment, however, the ring 216 may be circumferentially continuous and coupled to the surface 224 with a bonding material 260 between an outer surface of the ring 216 and a corresponding inner portion of the interior surface 224. The ring 216 also may carry indicia 250. The bonding material 260 may include room temperature vulcanizing (RTV) silicone, heat-activated ceramic or glass bonding compound, a solder glass, a ring of soda lime glass, an adhesive, an epoxy, or a sol-gel adhesive, or the like.

This embodiment is particularly adapted for use with a ceramic or glass ring 216 that may not be easily attachable to the containers of the previous embodiments.

Figure 6:
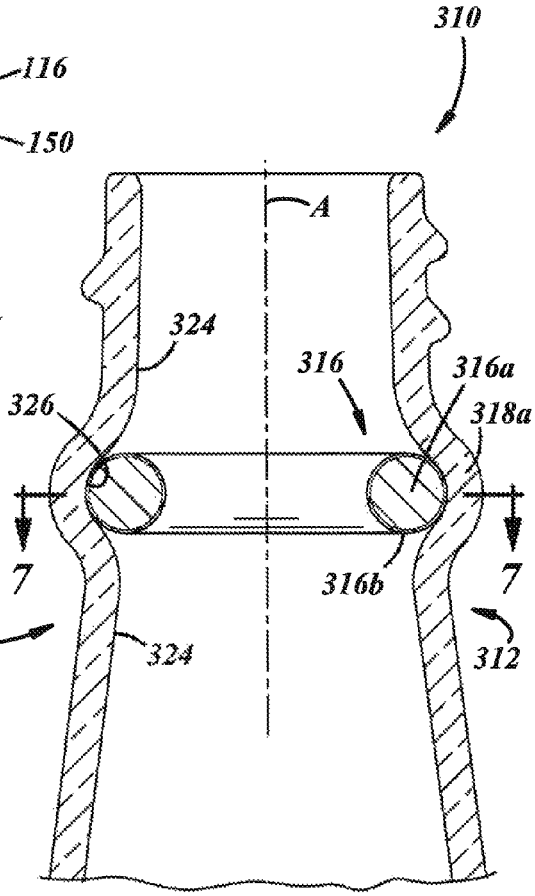
FIG. 6 is a fragmentary, elevational, cross-sectional view of a product in accordance with an illustrative embodiment of the present disclosure, and including a container, and an attachment ring for the container.
Figure 7:
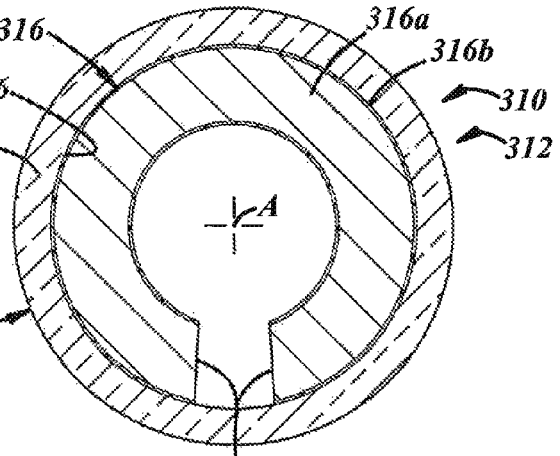
FIG. 7 is a cross-sectional view of the product of FIG. 6, taken along line 7-7 of FIG. 6.

FIGS. 6 and 7 illustrate another illustrative embodiment of a package 310 including a container 312 and an attachment ring 316 non-removably coupled to the container 312. This embodiment is similar in many respects to the embodiment of FIGS. 1-5 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Referring now to FIG. 6, the container 312 includes an annular relief 326 to receive the attachment ring 316. The annular relief 326 may be established by a radially outwardly extending bulge 318*a*, which may be formed in the wall of the container neck 318 and may have an internal diameter larger than that of axially adjacent portions of an internal surface 324 of the container neck 318. The bulge 318*a* may be formed during forming of a blank or parison for the container 312 and/or during forming of the container 312 itself. In other embodiments, the annular relief 326 may be a machined groove or a formed groove, or a space between radially inwardly projecting portions of the container neck 318.

In any case, the attachment ring 316 includes a substrate 316*a* and a coating 316*b* carried by the substrate 316*a*. The substrate 316*a* may include a metal and the coating may include a polymer. In one example, the metal may include stainless steel, and the polymer may include polyethylene, polypropylene, and/or any other suitable material.

In one embodiment, the attachment ring 316 may be C-shaped and may be assembled to the container 312 by radially compressing the ring 316 and inserting the ring 316 into the container neck 318 until the ring 316 is axially aligned with the relief 326. At that point, the ring 316 is allowed to expand into registration with the relief 326 in contact with the container neck 318.

In another embodiment, the attachment ring 316 may be assembled to the container 312 using a shrink fit. For example, the ring 316 may be frozen to reduce the diameter of the ring 316, and inserted into the container neck 318 until the ring 316 is axially aligned with the relief 326. At that point, the ring 316 may be warmed, or allowed to warm, to expand into registration with the relief 326 in contact with the container neck 318.

Referring now to FIG. 7, the ring 316 may be C-shaped, having circumferential ends 317 spaced apart circumferentially. In other embodiments, the ring 316 may be circumferentially continuous.

In any case, if a counterfeiter attempts to apply heat to the attachment ring 316, for example, in an effort to melt the ring 316 and an anti-refill fitment (not shown), the metal ring 316 will expand at a faster rate and to a larger degree relative to the glass wall of the neck 318. Such expansion of the metal ring 316 will crack or otherwise break the container neck 318, thereby providing an indication or evidence of tampering with the container 312.

FIGS. 8-14 illustrate another illustrative embodiment of a package 410 including a container 412, a fitment 414 non-removably coupled to the container 412, and an attachment ring 416 attached to the container 412 and to the fitment 414. This embodiment is similar in many respects to the embodiments of FIGS. 1-7 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 8:
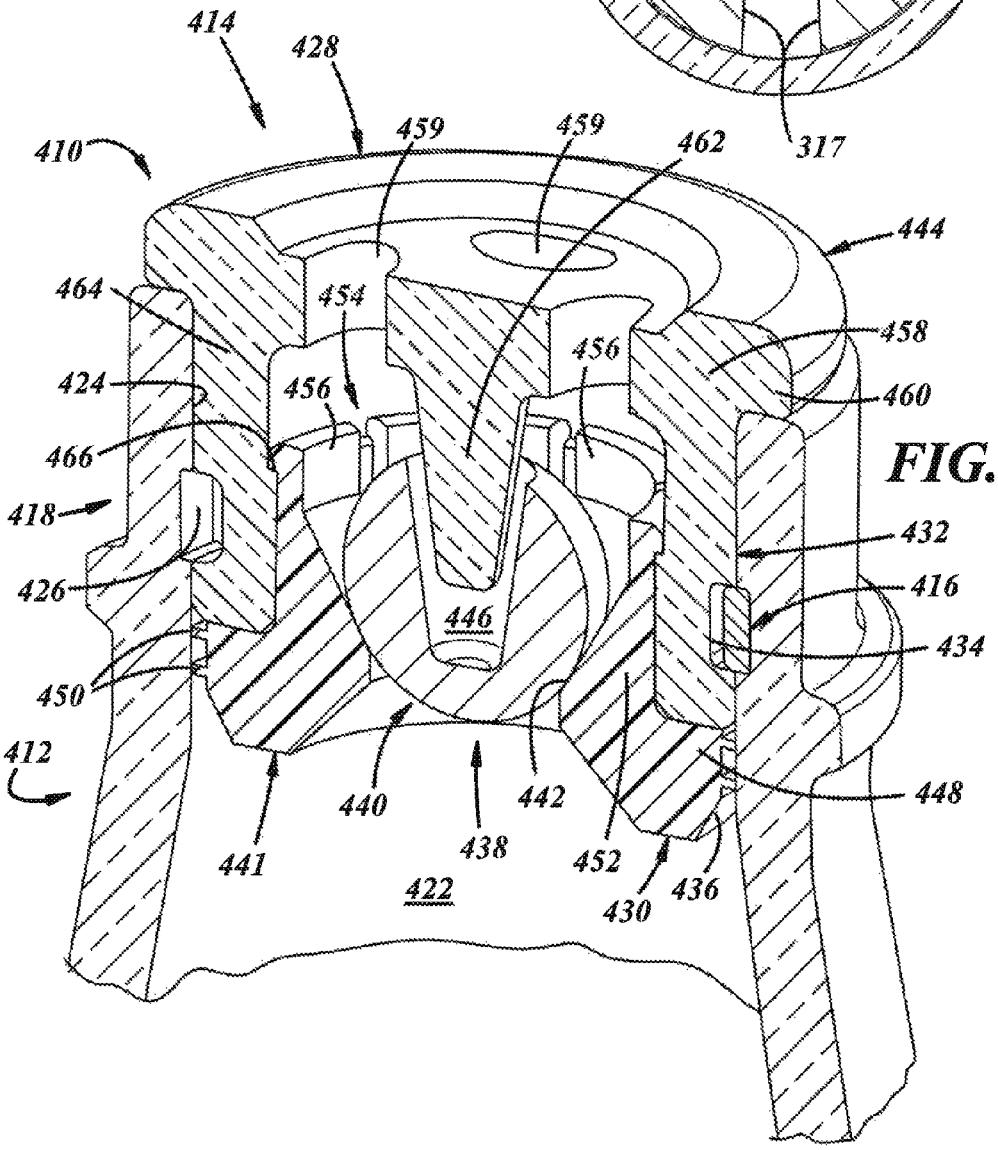
FIG. 8 is a fragmentary, perspective, cross-sectional view of a product in accordance with another illustrative embodiment of the present disclosure, and including a container, an anti-refill fitment coupled to the container, and an attachment ring coupling the fitment to the container.
Figure 14:
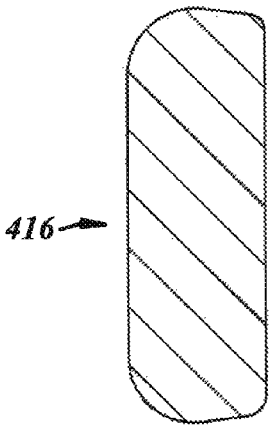
FIG. 14 is an enlarged cross-sectional view of the attachment ring illustrated in FIG. 11, taken from circle 14 of FIG. 11.

Referring to FIG. 8, the fitment 414 may include a dispensing member 444 carried in the container neck 418, a valve seat member 441 coupled to the dispensing member 444, and a check valve 438 also carried in the container neck 418 and which may be coupled to the dispensing member 444. The fitment 414 may include a first end 428, a second end 430 disposed axially oppositely of the first end 428, and an axially extending circumferential outer wall 432 (in the dispensing member 444, for example) between the ends 428, 430 and in contact with an interior surface 424 in a passage 422 of the container 412. The fitment 414 also may include an external annular recess 434 in the outer wall 432 corresponding to an internal annular recess 426 of the container 412 and for receiving at least a portion of an attachment ring 416 (FIG. 14). The fitment check valve 438 may be carried radially inwardly or within the outer wall 432. The check valve 438 may include a check ball 440, the valve seat member 441 carrying the ball 440 and forming a valve seat 442 for the ball 440. The ball 440 may include a pocket 446 therein that may extend partially but not all of the way through the ball 440. For example, the pocket 446 may extend over 50% of the diameter of the ball 440. The pocket 446 may be frustoconical in shape.

Figure 12:
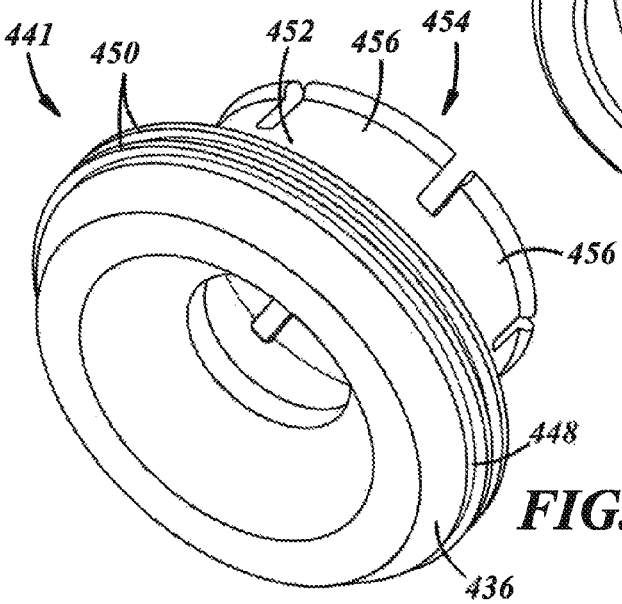
FIG. 12 is an enlarged perspective view of a valve seat member of the fitment of FIG. 8.

With reference also to FIG. 12, the valve seat member 441 may include a radial or transverse wall 448, which may include integral and annular seal elements 450 extending therefrom for sealing against the inside surface 424 of the container neck 418 (FIG. 8). The valve seat member 441 also may include a longitudinal wall 452 extending from a radially inward portion of the transverse wall 448 and which may include a coupling portion 454 coupled to the dispensing member 444 (FIG. 8). The coupling portion 454 may include a plurality of circumferentially spaced leaves 456. The leaves 456 may be bayonet shaped for interlocking with corresponding portions of the dispensing member 444 (FIG. 8). A radially inward portion of the longitudinal wall 452 may be frustoconical in shape to establish the valve seat 442. The fitment 414 also may include a chamfer 436 between the first end 428 and the outer wall 432. (FIG. 8)

Figure 13:
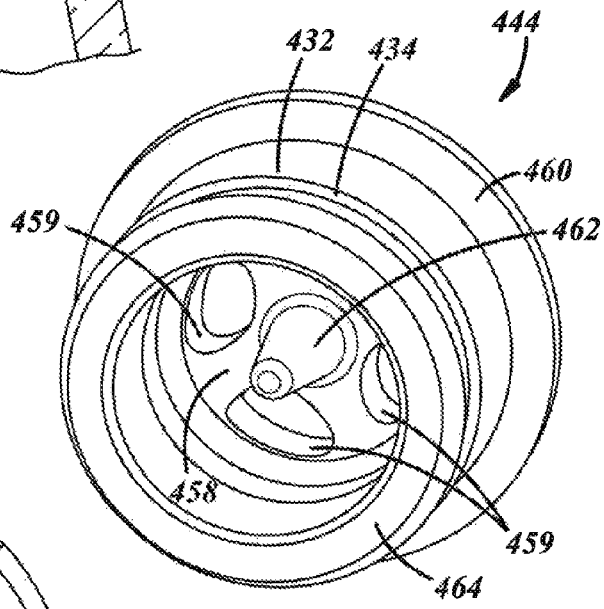
FIG. 13 is an enlarged perspective view of a dispensing member of the fitment of FIG. 8.

With reference to FIGS. 8 and 13, the dispensing member 444 may include a base wall 458, which may extend transversely or radially, and may include dispensing apertures 459, and a radially outward portion 460 for overlapping the lip of the container 412 (FIG. 8). The member 444 also may include a ball guide 462 extending longitudinally from the base wall 458 and into the passage 446 of the check ball 440 (FIG. 8). The ball guide 462 may be frustoconical in shape to correspond to the check ball passage 446 (FIG. 8). The member 444 further may include a radially outer wall 464 extending longitudinally from the base wall 458. The outer wall 464 may include an internal shoulder 466 for cooperating with the coupling portion 454 of the valve seat member 441 (FIG. 8), and also may include a portion of the outer wall 432 and the external annular recess 434 in the outer wall 432. The dispensing member 444 may be composed of glass, or any other suitable material, for example, that may have melting temperature greater than or equal to 650 degrees Celsius. Although not shown, the dispensing member 444 may carry indicia (see, e.g., FIG. 3) on the outer wall 432, for instance. The indicia may be created with a femto-second laser engraver, or any other suitable apparatus.

Referring to FIG. 8, the ring 416 may be composed of metal, for example, steel and may include an oxidizable coating. The ring 416 may be installed to the container 412 under inert gas conditions and sealed thereto with a closure or the like. If the member 444 is broken by counterfeiters, then air will contact and oxidize the ring 416, thereby providing visible evidence of attempted counterfeiting, for instance, as described above with respect to FIGS. 3-4.

Figure 9:
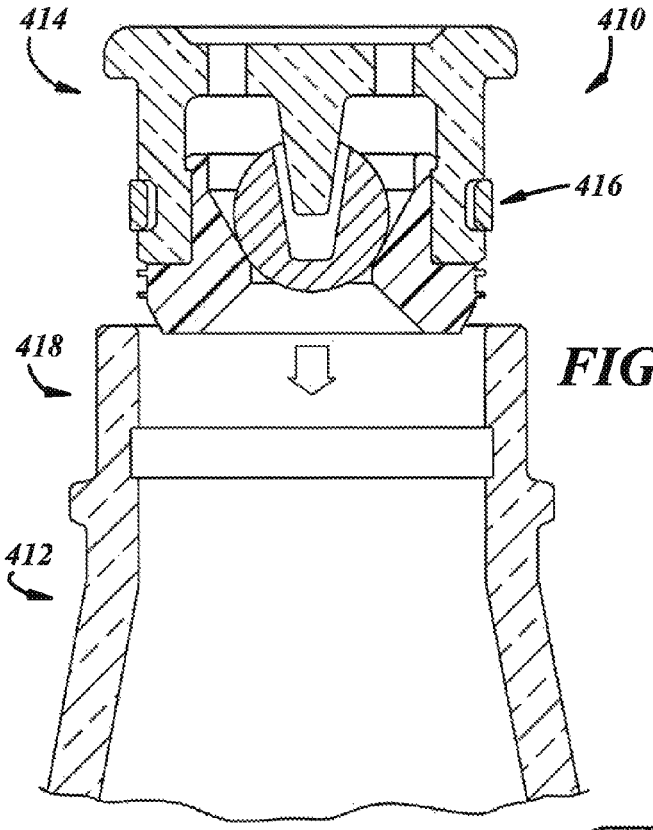
FIG. 9 is a fragmentary, exploded, cross-sectional view of the product of FIG. 8, illustrating the fitment and the attachment ring being assembled into the container.
Figure 10:
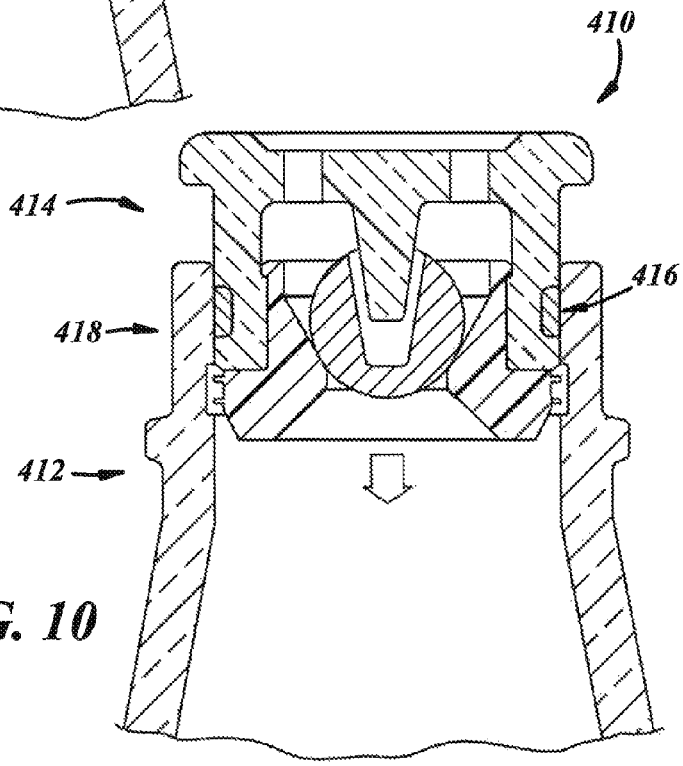
FIG. 10 is a fragmentary cross-sectional view of the product of FIG. 8, illustrating the fitment and the attachment ring further being assembled into the container.
Figure 11:
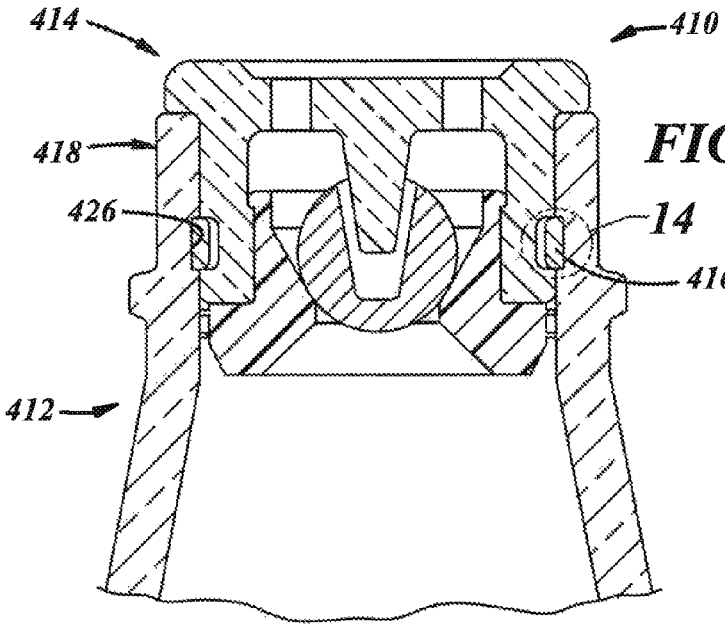
FIG. 11 is a fragmentary cross-sectional view of the product of FIG. 8, illustrating the fitment and the attachment ring assembled to the container.

As shown in FIG. 9, the fitment 414 may be assembled into the container 412 wherein the ring 416 may be radially compressed in any suitable manner so as to fit in the container neck 418. For example, the ring 416 may be compressed by hand or by any suitable tooling, for example, an assembly sleeve, a radial clamp, or the like. In another embodiment, the ring 416 may be provided with a lead in chamfer to facilitate press fit of the fitment 414 and ring 416 to the container 412. As shown in FIG. 10, once the ring 416 is compressed and inserted into the container neck 418, the fitment 414 and ring 416 are further displaced down into the container neck 418 until, as shown in FIG. 11, the ring 416 resiliently expands into registration with the recess 426 of the container neck 418 to non-removably secure the fitment 414 to the container 412.

Figure 15:
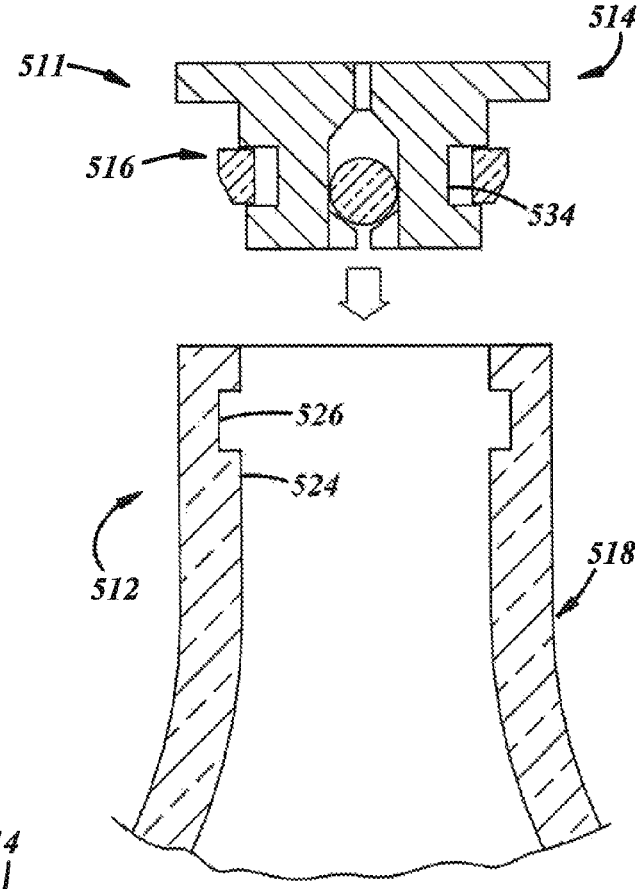
FIG. 15 is a fragmentary, elevational, exploded, cross-sectional view of a product in accordance with an illustrative embodiment of the present disclosure, and including a container, an anti-refill fitment being assembled to the container, and an attachment ring coupling the fitment to the container.
Figure 16:
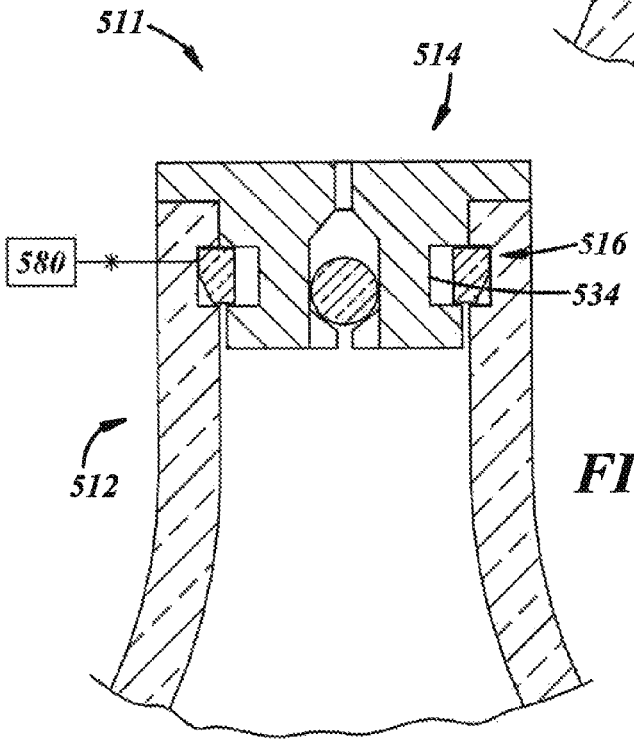
FIG. 16 is a fragmentary cross-sectional view of the product of FIG. 15, illustrating the ring being bonded to the container of FIG. 15.

FIGS. 15-16 illustrate another illustrative embodiment of a product 511 including a container 512, a fitment 514 coupled to the container 512, and an attachment ring 516 non-removably coupled to the container 512. This embodiment is similar in many respects to the embodiments of FIGS. 1-14 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The product 511 includes the container 512 to hold an original product therein, and the dispensing fitment 514 for coupling to the container 512 for non-refillable dispensing of the product out of the container 512, and the ring 516 initially carried by the fitment 514, for example, in an external annular recess 534 thereof. The fitment 514 and ring 516 are inserted into the container 512 until the ring 516 snaps into engagement with an internal recess 526 in an interior surface 524 of a neck 518 of the container 512.

Then, as shown in FIG. 16, a heat source 580 may be used to fuse at least a portion of the ring 516 to the container 512. For example, the heat source 580 may include a focused beam to melt a radially outer surface of the ring 516, an axial end surface of the ring 516, or the like, and corresponding portions of the container neck 518 to bond the ring 516 to the container neck 518. In this example, any suitable apparatus may produce any suitable type of focused beam, for instance, light amplified by stimulated emission of radiation (laser) beam, focused ion beam, or the like. In another example, the heat source 580 may include a torch flame, induction coil, or any other suitable heater.

Figure 17:
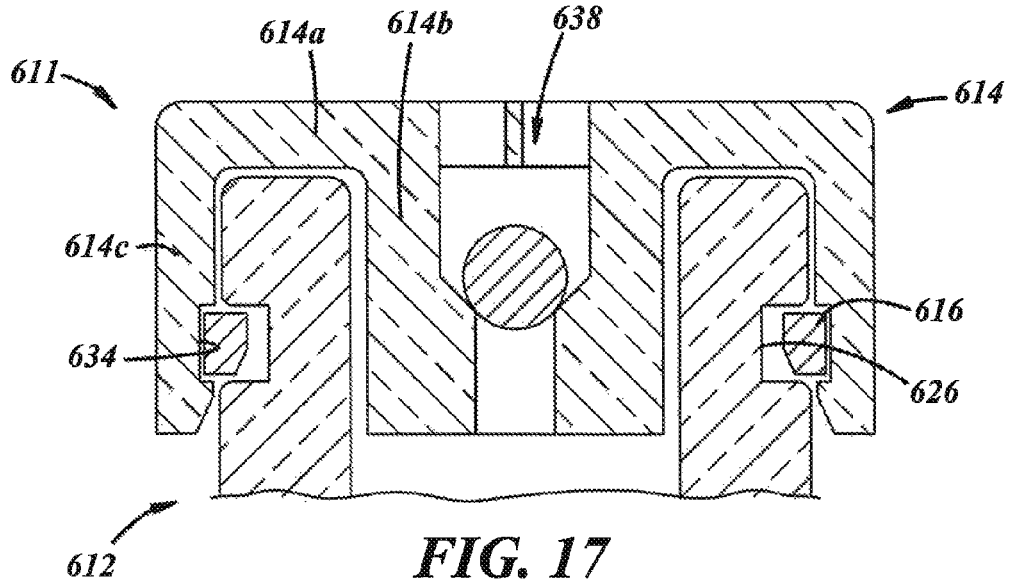
FIG. 17 is a fragmentary, elevational, cross-sectional view of a product in accordance with an illustrative embodiment of the present disclosure, and including a container, an anti-refill fitment assembled to the container, and an external attachment ring between the fitment and the container to couple the fitment to the container.

FIG. 17 illustrates another illustrative embodiment of a product 611 including a container 612, a fitment 614 coupled to the container 612, and an attachment ring 616 non-removably coupled to the container 612 between the fitment 614 and the container 612. This embodiment is similar in many respects to the embodiments of FIGS. 1-16 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The product 611 includes the ring 616, which may be initially assembled to and carried by the container 612. For example, the ring 616 may be snap fit into an external annular recess 626 of the container 612. The external recess 626 may be defined by axially spaced facing shoulders, beads, or the like of the container 612. The fitment 614 includes a transversely extending base wall 614*a*, an axially extending internal portion 614*b* carrying a check valve 638 (shown schematically), and an axially extending outer annular skirt 614*c* having an annular recess 634 in an internal surface thereof. The fitment 614 is assembled into and over the container 612 until the ring 616 snaps into engagement with the recess 634 in the fitment skirt 614*c*. Accordingly, the ring 616 is non-removably secured to the container 612 and the fitment 614 is non-removably secured to the container 612 via the ring 616. Those of ordinary skill in the art will recognize that sizes, shapes, and configurations of the cooperating portions of the ring 616, the container 612, and the fitment 614 are application specific to achieve engagement according to desired forces, fits, and the like. Attempts to remove the fitment 614 will visibly damage the fitment 614, particularly when the fitment 614 is composed of glass, ceramic, or any other relatively brittle materials.

Figure 18:
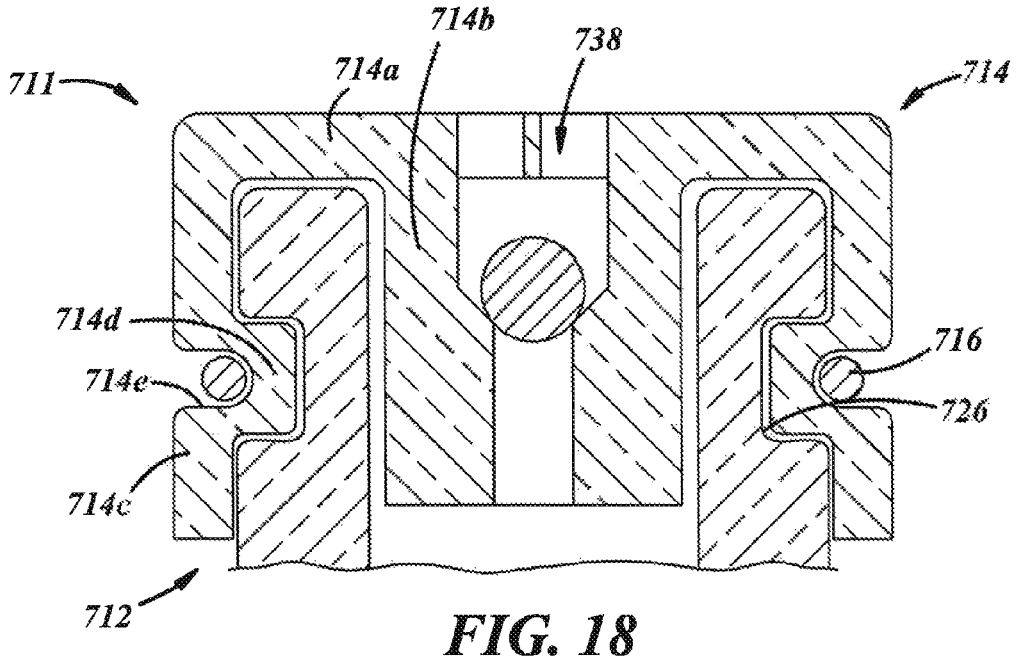
FIG. 18 is a fragmentary, elevational, cross-sectional view of a product in accordance with another illustrative embodiment of the present disclosure, and including a container, an anti-refill fitment assembled to the container, and an external attachment ring around the fitment to couple the fitment to the container.

FIG. 18 illustrates another illustrative embodiment of a product 711 including a container 712, a fitment 714 coupled to the container 712, and an attachment ring 716 non-removably coupled to the container 712 around the fitment 714. This embodiment is similar in many respects to the embodiments of FIGS. 1-17 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The fitment 714 includes a transversely extending base wall 714*a*, an axially extending internal portion 714*b* carrying a check valve 738 (shown schematically), and an axially extending outer annular skirt 714*c*. The skirt 714*c* includes a radially inwardly extending annular projection 714*d* non-removably secured within an external annular recess 726 in the container 712, and also includes an external annular recess 714*e* in an external surface thereof. The fitment 714 is assembled into and over the container 712 so that the projection 714*d* interlocks into the container recess 726. For example, the projection 714*d* may be snap fit, rolled, heat-formed, or the like into engagement with the recess 726. Also, the ring 716 may be carried by the container 712 via the fitment 714. For example, the ring 716 may be snap fit, rolled, heat-formed, or the like into the external annular recess 714*e* of the fitment 714. In any event, the ring 716 is non-removably secured to the container 712 with a portion of the fitment 714 positioned therebetween. Attempts to remove the fitment 714 will visibly damage the fitment 714, particularly when the fitment 714 is composed of glass, ceramic, or any other relatively brittle materials.

There thus has been disclosed an attachment ring for a container that may be used as an anchor, a use-evident indicator, and/or as a tamper-indicator, and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A product that includes: a container including a neck having an interior passage; and a ring non-removably coupled to the container neck, wherein the ring is composed of a base material and an oxidizable coating carried by the base material, and wherein the base material is a metal, and the oxidizable coating includes a reactive material that reacts with at least one of the constituents of air so as to visibly change appearance of the material.

2. The product set forth in claim 1, wherein the metal ring includes circumferential ends and is resiliently radially compressible.

3. The product set forth in claim 1, wherein the metal ring is located between axially spaced shoulders of the container neck.

4. The product set forth in claim 1, that includes a fitment non-removably coupled to the glass container via the ring and having an outer annular skirt with an internal annular projection and an external annular skirt recess, and an external annular container recess in the container neck, wherein the internal annular projection of the fitment extends into the external annular container recess and the ring is carried in the external annular skirt recess to non-removably couple the fitment to the glass container.

5. The product set forth in claim 1, wherein the metal ring is in contact with a corresponding internal surface of the container neck and secured thereto with adhesive.

6. The product set forth in claim 1, wherein the metal ring carries indicia visible from outside of the glass container.

7. The product set forth in claim 1, wherein the ring is adapted irreversibly to change a characteristic that is visible from outside of the container.

8. The product set forth in claim 7, that also includes a fitment non-removably coupled to the container via the ring.

9. The product set forth in claim 1, wherein the base material includes a metal substrate and the oxidizable coating includes a polymer coating carried by the metal substrate.

10. The product set forth in claim 1, wherein at least a portion of the metal ring is fused to the container.

11. A product that includes:

a container including a neck having an interior passage;

a ring non-removably coupled to the container neck; and a fitment non-removably coupled to the container via the ring, wherein the fitment includes:

a dispensing member including a base wall having dispensing openings, a valve seat member coupled to the dispensing member, and a valve ball captured between the dispensing and valve seat members, wherein the dispensing member also includes a valve ball guide extending from the base wall, and the valve ball has a pocket into which the valve ball guide extends.

12. The product set forth in claim 11, wherein a radial gap is established between the ring and a corresponding internal surface of the container neck and a portion of the fitment is resiliently displaced to accommodate the coupling of the fitment to the ring.

13. The product set forth in claim 11, wherein the fitment includes an outer annular skirt with an internal annular recess, and an external annular recess in the container neck, wherein the ring radially extends into the recesses to non-removably couple the fitment to the glass container.

14. The product set forth in claim 11, wherein the valve seat member includes an annular outer seal.

15. A method of producing a product that includes:

(a) flowing liquid into a glass container having a neck; and (b) non-removably coupling an anti-refill fitment to the neck of the glass container via a metal attachment ring to render the product tamper-evident, wherein the attachment ring is circumferentially continuous and adapted irreversibly to change a characteristic that is visible from outside of the glass container.

16. The method of claim 15 further comprising (c) melting at least a portion of the attachment ring to the container.

17. The product produced by the method of claim 15.

18. The method of claim 15, wherein the anti-refill fitment includes:

a dispensing member including a base wall having dispensing openings, a valve seat member coupled to the dispensing member, and a valve ball captured between the dispensing and valve seat members, wherein the dispensing member also includes a valve ball guide extending from the base wall, and the valve ball has a pocket into which the valve ball guide extends.

19. A method of producing a product that includes:

(a) flowing liquid into a glass container having a neck, and (b) non-removably coupling a fitment to the neck of the glass container via a metal attachment ring to render the product tamper-evident, wherein the attachment ring is circumferentially continuous and adapted irreversibly to change a characteristic that is visible from outside of the glass container, wherein the coupling step (b) includes:

(b1) inserting the fitment into the neck of the container until the attachment ring snap fits to at least one of the fitment or the container neck.

20. A method of producing a product that includes:

(a) flowing liquid into a glass container having a neck; and (b) non-removably coupling a fitment to the neck of the glass container via a metal attachment ring to render the product tamper-evident, wherein the attachment ring is circumferentially continuous and adapted irreversibly to change a characteristic that is visible from outside of the glass container, wherein the characteristic is a color of the ring.

21. A package comprising:

a product that includes:

a glass container including a neck having an interior passage; and a metal ring non-removably coupled to the container neck, wherein the metal ring is circumferentially continuous and adapted irreversibly to change a characteristic that is visible from outside of the glass container original liquid product carried in the glass container;

a fitment coupled to the container to render the container non-refillable; and a closure coupled to the container, wherein the ring provides a use-evident indicator to indicate at least one of that the container has been opened or that the original liquid product has been dispensed from the container.

22. A product that includes:

a glass container including a neck having an interior passage; and a metal ring non-removably coupled to the container neck, wherein the metal ring is circumferentially continuous and adapted irreversibly to change a characteristic that is visible from outside of the glass container, wherein the characteristic is a color of the metal ring.

* * * * *